US006305649B1

(12) United States Patent
Walmsley et al.

(10) Patent No.: US 6,305,649 B1
(45) Date of Patent: Oct. 23, 2001

(54) RETAINING DEVICE

(75) Inventors: Owen Walmsley, Wood Howe, 13 Glenspan Park, Roy Bridge, Invernesshire, PH31 4AS; Robert Emmett, 65 Chequers Avenue, Lancaster, LA1 4HZ, both of (GB)

(73) Assignees: Owen Walmsley; Robert Emmett, both of (GB)

( * ) Notice: Subject to any disclaimer, the term of this patent is extended or adjusted under 35 U.S.C. 154(b) by 0 days.

(21) Appl. No.: 09/324,848

(22) Filed: Jun. 3, 1999

(30) Foreign Application Priority Data

Jun. 5, 1998 (GB) ..... 9812080

(51) Int. Cl.[7] ..... F16L 3/00
(52) U.S. Cl. ..... 248/49; 248/313
(58) Field of Search ..... 248/49, 65, 313, 248/316.3, 113; 166/209

(56) References Cited

U.S. PATENT DOCUMENTS 2,676,036 * 4/1954 Arrowood ..... 285/123.8
2,683,046 * 7/1954 Allen ..... 285/123.8
2,887,754 * 5/1959 Johnson ..... 188/67
3,130,987 * 4/1964 Johnson ..... 285/123.8
3,472,535 * 10/1969 Kinley ..... 285/123.11
3,579,753 * 5/1971 Pryor ..... 188/67
3,986,583 * 10/1976 Kinzbach ..... 188/67
4,715,625 * 12/1987 Shows, Jr. et al. ..... 285/123.11
5,484,222 * 1/1996 Schulze-Beckinghausen ..... 403/307
5,609,226 * 3/1997 Penisson ..... 188/67
5,732,909 * 3/1998 Soonier ..... 248/49
5,992,801 * 11/1999 Torres ..... 248/49

* cited by examiner

*Primary Examiner*—Anita King
*Assistant Examiner*—N. Morrison
(74) *Attorney, Agent, or Firm*—Samuels, Gauthier & Stevens

(57) ABSTRACT

A retaining device to prevent linear movement of an elongate member (10) in the downwards direction comprising a plurality of segmental ball slips (14) surrounding the member (10) and removably introduced into a tapered opening in a supported bushing (13), each ball slip (14) including a ball cage (18) having balls (20) and ramps (21) and a spring (19) urging the ball cage downwardly and thus the balls inwardly to grip the elongate member with a smooth rolling action preventing surface damage to the elongate member. The ball slips (14) may be hinged together around the elongate member (10) and may removed manually or by power operated means at (22).

8 Claims, 2 Drawing Sheets

RETAINING DEVICE

THIS INVENTION concerns a retaining device to prevent linear movement of an elongate member in one direction, and is particularly though not exclusively concerned with a device to hold a length of vertical drilling tube permanently or temporarily at a pre-determined level.

According to the present invention a retaining device to prevent linear movement of an elongate member in one direction comprises at least one retaining member adapted in combination to engage an outer wall surface of the elongate member, each retaining member having at least one gripping member movable with respect to the retaining member into engagement with the elongate member; characterised in that the gripping member is constructed so as to engage the elongate member with a rolling action.

An embodiment of the invention will now be described, by way of example only, with reference to the accompanying drawings, in which.

FIG. 1 generally illustrates a vertical length of steel tube held at a pre-determined level by a retaining device made in accordance with the invention;

Figure 4A:
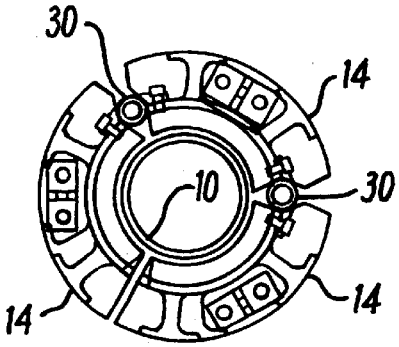
Figure 4B:
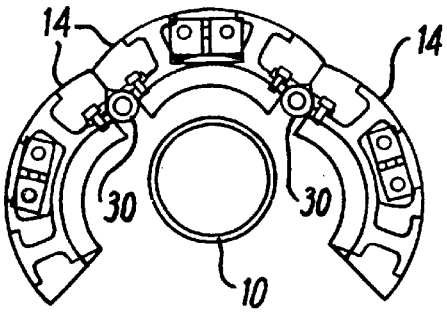

FIGS. 4*a* and 4*b* illustrate, in plan, how the device is comprised of separate parts hinged together.

Figure 3:
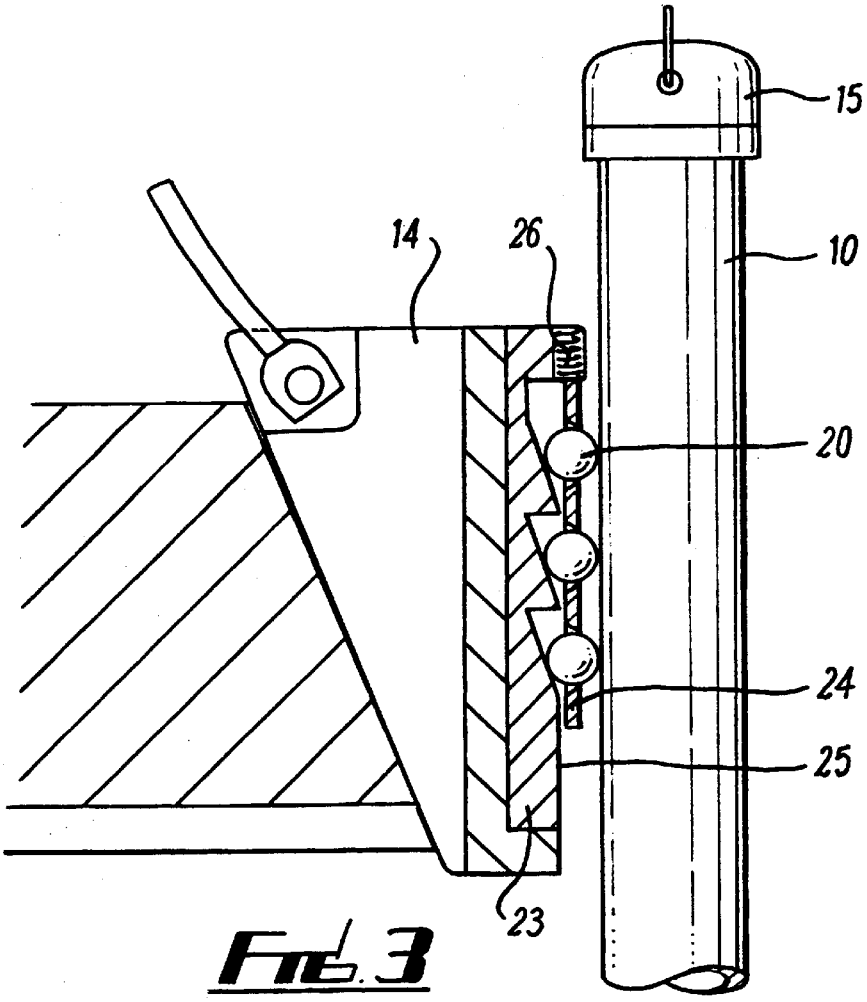
FIG. 3 is a similar view of a modification.

Referring now to the drawings, and in a practical application of the invention, when it is required to retain a length of chromium steel tubing 10 at a pre-determined level in relation, for example, to the floor 11 of a drilling rig, the tubing passing down through a tapered opening 12 in a master bushing 13, ball slips 14 are introduced in wedge-like manner into the tapered opening 12 to grip and retain the tubing 10 normally supported by an elevator illustrated at 15 in FIG. 3.

Devices of this kind conventionally include a toothed inner face on the slips 14 which engage and grip the outer wall of the tubing 10. However, with chromium steel tubes, the teeth bite into the outer surface of the tube wall leaving jagged indentations leading to premature corrosion of the tubing.

Figure 2:
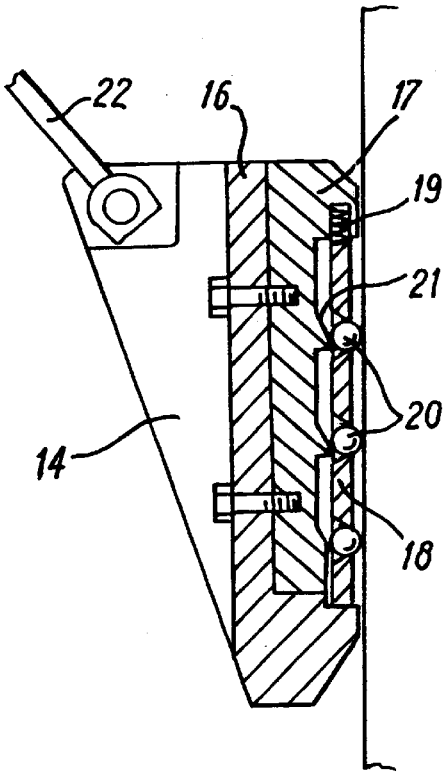
FIG. 2 is an enlarged view of part of a retaining device illustrated in FIG. 1.

In accordance with the invention, and as illustrated in FIGS. 2 and 3, each segmental ball slip 14 of which there may be three or four partially or wholly surrounding the tubing 10, comprises a weighted body 16 having a multiple-ramped inner part 17 with a ball cage 18 spring-biassed downwardly by springs 19 and carrying a plurality of rollers or balls 20 so arranged that as the ball cage 18 descends in relation to the slip 14 the balls 20 are forced inwardly by the ramped configuration illustrated at 21 whereby the curved or spherical surfaces of the balls or rollers 20 engage the outer surface of the tubing 10 with a rolling action.

Each slip 14 is removable from the tapered aperture 12 in the master bushing 13 by means of a handle 22 when not required.

Referring now to FIG. 3, in a modified arrangement the multiple ramped part 23 is arranged with the ramps more closely adjacent vertically and with the ball cage 24 movable along and with respect to the inner surface 25 of the ramped member. Again, springs 26 urge the balls in a downwards and inwards direction.

FIG. 4*a* shows the slips 14 entirely surrounding the pipe 10, with hinged connections 30 between the slips so that they may be swung open and away from the pipe as illustrated in FIG. 4*b*.

The slips may be maneuvered by a power operating, and automatic, system (not shown) instead of the need to grip the manual handles 22.

Figure 1:
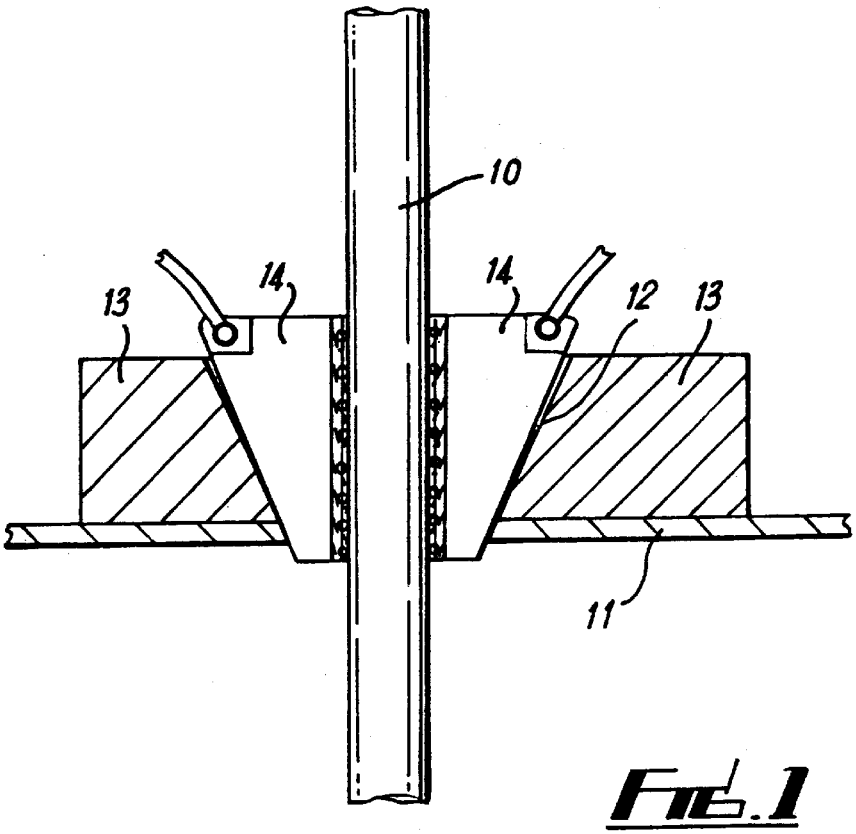

In use therefore, during the operation of lowering the tubing 10 through the aperture 12 in the master bushing 13, when it is required to support the weight of the tube 10 at the level of the rig floor 11, the ball slips are placed around the tube 10 and lowered into position as shown in FIG. 1. The springs 19, 26 are designed so that the weight of the ball slips will cause the ball cage 18, 24, to move outwardly with the balls riding along the ramps until they touch the tube wall. Usually, the tube 10 will be held at a pre-determined height by the elevator 15 during insertion of the ball slips 14. Then when the elevator 15 releases the tube 10 the balls will grip the latter and prevent it from further descent.

The rolling engagement of the balls or rollers 20 prevents undue or jagged indentation of the outer wall of the tube when compared with the sliding action of a conventional toothed device. Any identation in the wall therefore has a smooth unbroken edge thus considerably reducing or preventing premature corrosion of the surface of the tube.

What is claimed is:

1. A retaining device to prevent linear movement of an elongate member in one direction, comprising at least one retaining member adapted to engage an outer wall surface of the elongate member, said at least one retaining member having at least one gripping member movable with respect to the retaining member into engagement with the elongate member; characterised in that the gripping member includes balls/rollers which are so disposed as to engage the elongate member with a rolling action.

2. A retaining device according to claim 1, comprising at least two retaining members adapted in combination to engage the outer wall surface of the elongate member, each retaining member having gripping members which engage the elongate member with a rolling action.

3. A retaining device according to claim 1 or claim 2, wherein the or each retaining member comprises a body having a ball/roller cage movable axially with respect to the body and, in use, with the elongate member and containing a plurality of balls/rollers each associated with an inclined ramp on the body, the ball/roller cage being spring-loaded and urged in a direction which causes the balls to move inwardly to grip the elongate member.

4. A retaining device according to claim 1, including two retaining members adapted to be located in generally opposed positions about the elongate member within a tapered bushing, in wedge-like manner to grip and retain the elongate member.

5. A retaining device according to claim 1, wherein the retaining member includes means for withdrawing it from the elongate member by an upwards movement in relation thereto.

6. A retaining device according to claim 1, including a plurality of retaining members adapted to surround the elongate member and hingedly attached together for removal therefrom.

7. A retaining device according to claim 1, including a powered device adapted to maneuver the retaining member with respect to the elongate member.

8. A retaining device according to claim 1, including at least three retailing members adapted to partially or wholly surround the elongate member and each comprising a weighted body having a multiple-ramped inner part with a ball/roller cage spring-biased downwardly and carrying a plurality of balls/rollers so arranged that as the ball/roller cage descends in relation to the device the balls/rollers are forced inwards by the multiple ramped inner part whereby surfaces of the balls/rollers engage the outer surface of the elongate member with a rolling action.

* * * * *

US006305649C1

(12) EX PARTE REEXAMINATION CERTIFICATE (10305th)

United States Patent
Walmsley et al.

(10) Number: US 6,305,649 C1
(45) Certificate Issued: Oct. 2, 2014

(54) RETAINING DEVICE

(75) Inventors: Owen Walmsley, Invernesshire (GB); Robert Emmett, Lancaster (GB)

(73) Assignee: BSW Limited, Lancaster (GB)

Reexamination Request:
No. 90/013,110, Jan. 2, 2014

Reexamination Certificate for:

| | |
|---|---|
| Patent No.: | **6,305,649** |
| Issued: | **Oct. 23, 2001** |
| Appl. No.: | **09/324,848** |
| Filed: | **Jun. 3, 1999** |

(30) Foreign Application Priority Data

Jun. 5, 1998 (GB) ..... 9812080

(51) Int. Cl.
*F16L 3/00* (2006.01)

(52) U.S. Cl.
USPC ..... 248/49; 248/313

(58) Field of Classification Search
None
See application file for complete search history.

(56) References Cited

To view the complete listing of prior art documents cited during the proceeding for Reexamination Control Number 90/013,110, please refer to the USPTO's public Patent Application Information Retrieval (PAIR) system under the Display References tab.

*Primary Examiner* — Robert M. Fetsuga

(57) ABSTRACT

A retaining device to prevent linear movement of an elongate member (10) in the downwards direction comprising a plurality of segmental ball slips (14) surrounding the member (10) and removably introduced into a tapered opening in a supported bushing (13), each ball slip (14) including a ball cage (18) having balls (20) and ramps (21) and a spring (19) urging the ball cage downwardly and thus the balls inwardly to grip the elongate member with a smooth rolling action preventing surface damage to the elongate member. The ball slips (14) may be hinged together around the elongate member (10) and may removed manually or by power operated means at (22).

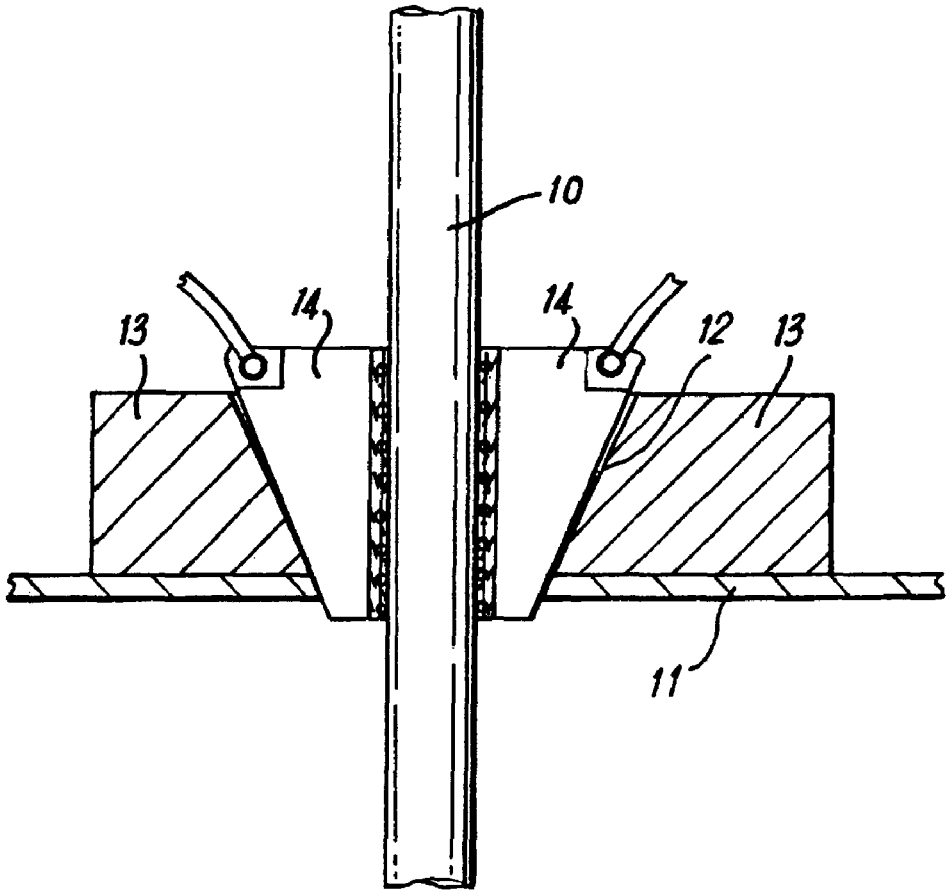

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-8 are cancelled.

* * * * *